United States Patent [19]

Mitsuyama

[11] Patent Number: 4,790,474

[45] Date of Patent: Dec. 13, 1988

[54] DOCUMENT FILE

[76] Inventor: Masuhiro Mitsuyama, 1071, Kinugasa, Wake-cho, Wake-gun, Okayama, Japan

[21] Appl. No.: 32,590

[22] Filed: Apr. 1, 1987

[30] Foreign Application Priority Data

Jan. 30, 1987 [JP] Japan ..... 62-13168[U]

[51] Int. Cl.[4] ..... B65D 3/00

[52] U.S. Cl. ..... 229/1.5 R; 229/72; 229/120.02

[58] Field of Search ..... 229/1.5 R, 72, 120.02, 229/120.25, 120.31; 206/554

[56] References Cited

U.S. PATENT DOCUMENTS

| | | | |
|---|---|---|---|
| 574,974 | 1/1897 | Wiley | 229/72 |
| 916,206 | 3/1909 | Shedd | 229/1.5 R |
| 1,698,841 | 1/1929 | Doughty | 229/72 |
| 2,715,493 | 8/1955 | Vogt | 206/554 |
| 2,756,515 | 7/1956 | Hoffman | 229/72 |
| 4,331,290 | 5/1982 | Benham | 229/72 |

*Primary Examiner*—Willis Little

*Attorney, Agent, or Firm*—Wenderoth, Lind & Ponack

[57] ABSTRACT

An improved document file is proposed which has a pair of covers, a plurality of bag members laminated one upon another, and a plurality of reinforcing padding members mounted in pocket-like or sheaths spaces formed between the adjoining bag members. The padding members serve to eliminate any difficulty in opening the compartments formed by the bag members, due to limpness of the material of which the bag members are made.

4 Claims, 2 Drawing Sheets

DOCUMENT FILE

BACKGROUND OF THE INVENTION

The present invention relates to a document file.

The conventional document file comprises a pair of covers and a plurality of bag members fixed thereto and to one another and having openings at upper ends thereof. The bag members are limp because they are made of soft synthetic resin sheets. Consequently, when the bag members are expanded in a direction perpendicular to the surface of the cover, the openings will not gape but the sheeps remain overlapped. This prevents papers from being smoothly put into the compartments. Anyone who tries to take out the papers already accommodated in the bag member also encounters a difficulty in running his fingers into the opening of the bag member.

SUMMARY OF THE INVENTION

It is an object of the present invention to provide a document file which prevents the limpness of the verges of the bag members and thereby eliminate the above-described disadvantages.

In accordance with the present invention, there is provided a document file comprising a pair of covers, a plurality of bag members stacked one upon another and sealed together, the outermost ones of the bag members being sealed to the respective covers, and reinforcing padding members mounted in spaces formed between each of pairs of the adjoining ones of the bag members by sealing them only partially.

With the above-described object in view and as will become apparent from the following detailed description, the present invention will be more clearly understood in connection with the accompanying drawings.

DETAILED DESCRIPTION OF THE INVENTION

Figure 1:
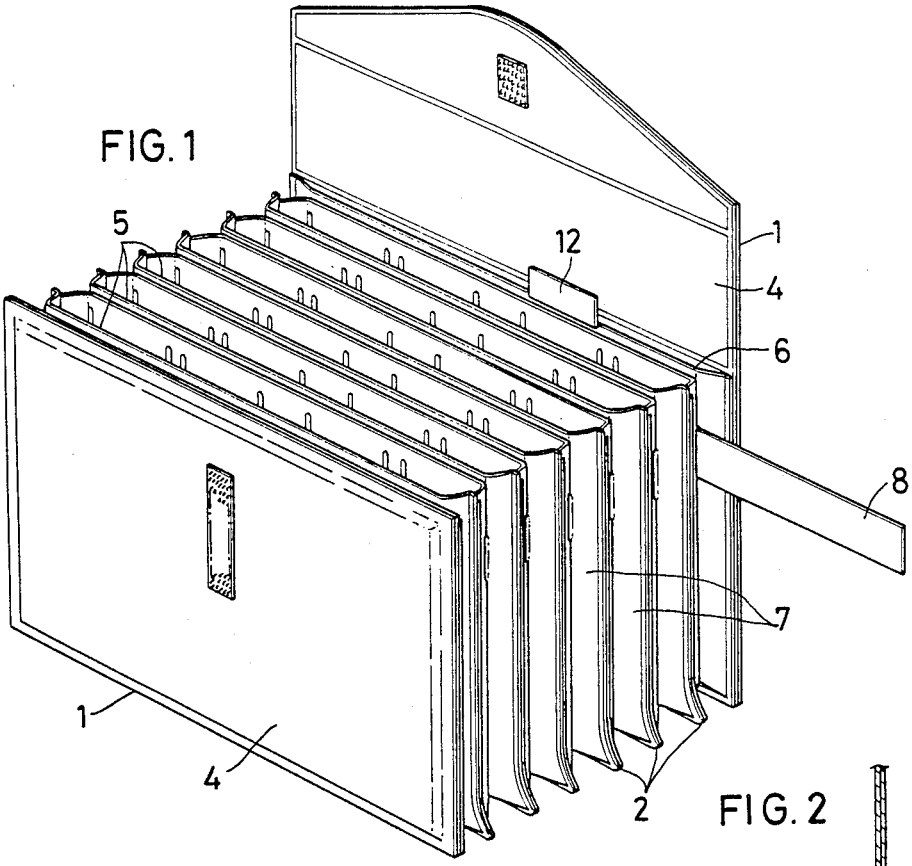
FIG. 1 is a perspective view of a document file according to the present invention in its expanded state.
Figure 2:
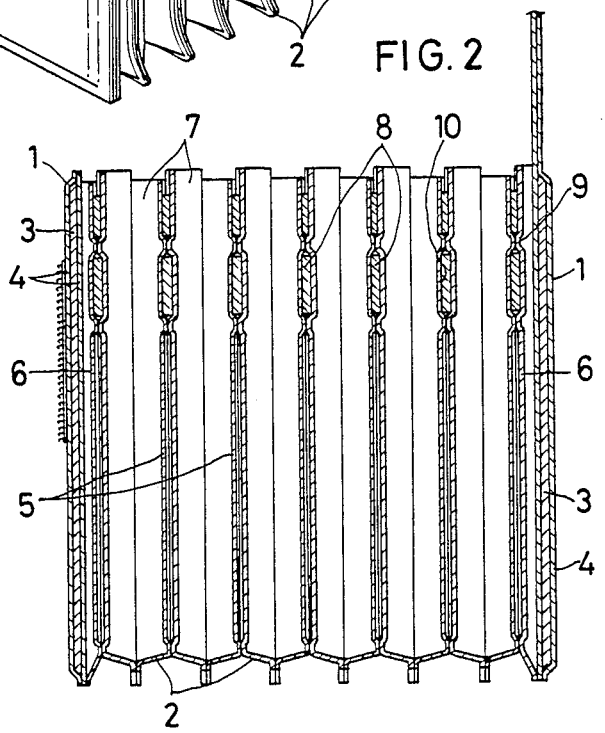
FIG. 2 is a vertical sectional side view thereof.

Referring now to FIGS. 1 and 2, a document file in accordance with the present invention includes a pair of covers 1 and a plurality of bag members or compartments 2 fixed to the covers and to one another and having openings at their upper ends.

As shown in FIG. 2, each cover 1 comprises a reinforcing padding 3 such as cardboard and a synthetic resin sheet 4 with which the padding 3 is enclosed. If desired, the cover 1 may be made of any other material.

As shown in FIGS. 1 and 2, the bag members 2 are made of soft synthetic resin sheets 5 and are arranged one upon another and subjected to high frequency sealing to seal them together at their upper, lower and both side edges. An auxiliary sheet 6 is hot-sealed to the sheet 4 at back side of each cover 1. The sheets 5 of the outermost bag members of the assembly of bag members 2 are hot-sealed to the auxiliary sheets 6 at their upper, lower and both side edges.

As shown in FIGS. 1 and 2, gussets 7 for allowing the bag members 2 to accommodate more papers are provided to the lower and both side edges of the bag members 2. However, the bag members 2 may not have the gussets 7.

Figure 3:
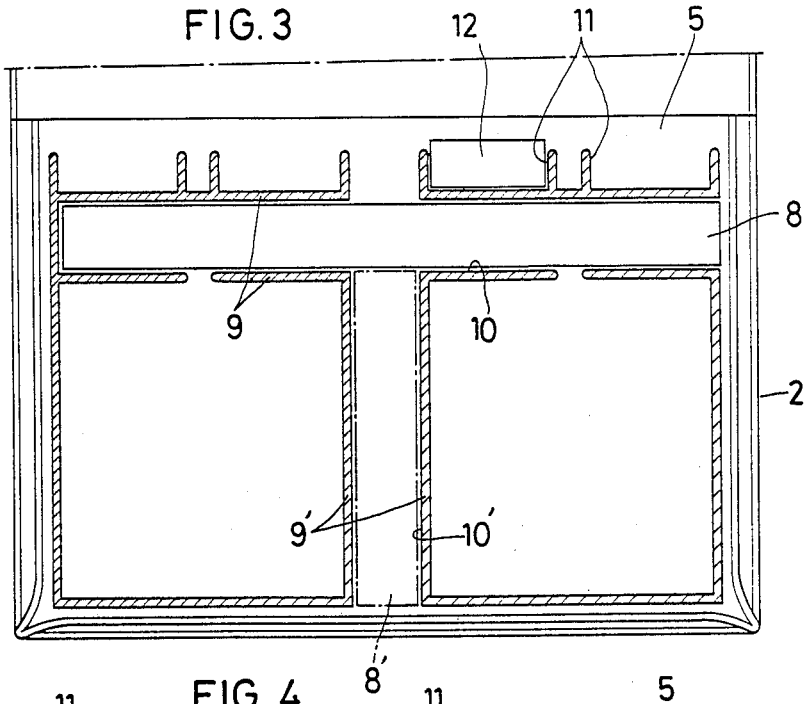
FIGS. 3 to 5 are vertical sectional front views thereof, illustrating the padding inserted in position.

In order to eliminate the limpness of the verges of the bag members, paddings 8 are held in place between each pair of the sheets 5 of the adjoining bag members 2. The padding 8 shown in FIG. 3 is made, e.g., of cardboard and can be inserted into a pocket-like sheath 10 defined by two sealing lines 9 extending parallel with the upper edge of the sheet 5. The pocket-like sheath 10 in FIG. 3 has an opening at one side only, whereas the sheath in Fig. 4 has an opening at both sides. Alternatively, though not shown, the sheath 10 may be formed in such a manner that the padding 8 is adapted to be inserted vertically from top of the sheets 5. Further alternatively, the paddings 8 may not be removable but be confined in the spaces between the sheets 5.

Figure 5:
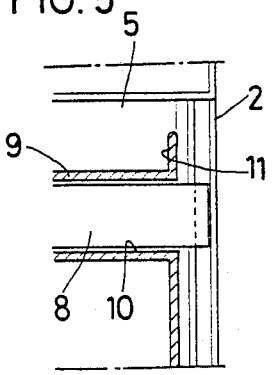

The padding 8 shown in FIG. 5 is long enough to allow one end portion thereof to project from the sheath 10 to provide space for indicating the papers filed in each particular compartment 2.

A reinforcing padding 8' shown in FIG. 3 can be inserted into a sheath 10' vertically from the bottom of the sheets 5. The sheath 10' is defined by two sealing lines 9' extending vertically in the midportion of the sheets 5. The paddings 8' serve to allow the file to stand by itself.

All the bag members 2 may not be provided with the paddings 8.

Figure 4:
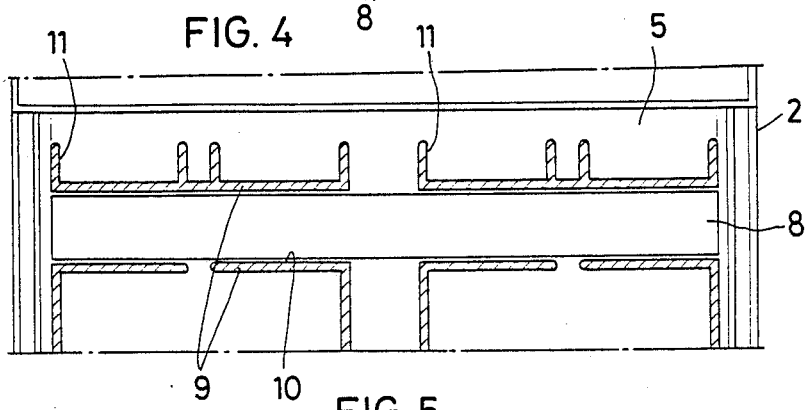

FIGS. 3 and 4 show a plurality of pockets 11 formed in the sheets 5 to hold a guide card 12.

Because the limpness of the verges of the bag members is cured by the paddings 8, the document file in accordance with the present invention allows papers to be easily put into and taken out of the compartments 2.

What I claim is:

1. A document file comprising:

a plurality of upwardly opening compartments attached together in accordion-like fashion;

a plurality of pocket-like sheaths defined between adjacent ones of said plurality of compartments for receiving a reinforcing padding member; and a plurality of reinforcing padding members removably inserted into said plurality of pocket-like sheaths for reinforcing and keeping open each compartment of said plurality of upwardly opening compartments.

2. A document file as in claim 1 wherein said plurality of pocket-like sheaths includes substantially vertical pocketlike sheaths and substantially horizontal pocket-like sheaths.

3. A document file as in claim 1 wherein ones of said plurality of reinforcing padding members have a greater length than the length of said plurality of pocket-like sheaths for leaving a part of each said reinforcing padding member projecting from each said pocket-like sheath, each said projecting part defining an area for receiving labelling means thereon.

4. A document file as in claim 1 further comprising a pair of covers, said plurality of compartments being between said pair of covers, and outermost ones of said plurality of compartments being attached to said pair of covers.

* * * * *